US005727432A

United States Patent [19]

Burns et al.

[11] Patent Number: 5,727,432

[45] Date of Patent: Mar. 17, 1998

[54] MANUALLY OPERABLE ROD HOLDER

[75] Inventors: Raymond W. Burns, Bethalto, Ill.; Kyle Oberlander, Florissant, Mo.

[73] Assignee: Central Mine Equipment Co., Earth City, Mo.

[21] Appl. No.: 550,019

[22] Filed: Oct. 30, 1995

[51] Int. Cl.[6] ..... B25B 13/50

[52] U.S. Cl. ..... 81/57.34; 81/57.35; 81/57.16; 269/228

[58] Field of Search ..... 81/57.33, 57.34, 81/57.35, 57.4, 57.41, 57.16, 57.24, 57.25, 367, 379, 128, 129; 269/228, 254 R

[56] References Cited

U.S. PATENT DOCUMENTS

| | | | |
|---|---|---|---|
| 2,467,600 | 4/1949 | Shipley | 269/254 |
| 2,692,520 | 10/1954 | Hayes . | |
| 2,714,198 | 7/1955 | Schloetzer | 81/379 |
| 2,777,347 | 1/1957 | Sendoykas | 81/379 |
| 3,028,577 | 4/1962 | Strauss | 81/379 |
| 3,044,512 | 7/1962 | Jones | 269/254 |
| 3,578,307 | 5/1971 | Lock | 269/228 |
| 3,799,009 | 3/1974 | Guier | 81/57.16 |
| 4,141,543 | 2/1979 | Kato | 269/228 |
| 4,345,493 | 8/1982 | Rassieur . | |
| 4,458,562 | 7/1984 | Jackson | 81/57.34 |
| 4,870,738 | 10/1989 | Rassieur . | |
| 4,872,697 | 10/1989 | Berkowitz | 269/228 |
| 5,040,438 | 8/1991 | Rousseau | 81/57.24 |

*Primary Examiner*—D. S. Meislin
*Assistant Examiner*—Joni B. Danganan
*Attorney, Agent, or Firm*—Polster, Lieder, Woodruff & Lucchesi, LC

[57] ABSTRACT

A manually operated mechanical rod holder has a support arm pivotally mounted on a drill rig chassis. A fixed jaw is mounted on an outboard end of the support arm. A movable jaw is mounted on a plate secured to a sleeve carried by the support arm. The sleeve is connected to an outer end of a sliding block that is slidably mounted in the sleeve. An inboard end of the block is connected to an outer end of an arcuate spring section integral with an operating lever. The inner end of the spring section is connected pivotally to an end of a link, the other end of which is pivotally mounted on the support arm. An inboard end of the operating lever has a handle. The throw of the movable jaw with respect to the fixed jaw remains constant. The distance between the movable jaw and the fixed jaw can be varied to accommodate different sizes of pipe or rod.

6 Claims, 2 Drawing Sheets

MANUALLY OPERABLE ROD HOLDER

BACKGROUND OF THE INVENTION

This invention relates to rod holders by which drilling rods or pipe strings are held to permit their being removed or added in sections.

It has been known, in a manually operated rod holder, to anchor a fixed jaw at the outer end of a supporting arm and to push a movable jaw toward the fixed jaw to clamp the rod or pipe (See U.S. Pat. No. 2,692,520) or, in some hydraulically operated rod holders, to provide two jaws, both moved by hydraulic cylinders toward and away from one another (See U.S. Pat. Nos. 4,870,738 and 4,345,493, for example). Hydraulically operated rod holders are effective, but they are expensive and, of course, require a hydraulic pump, piping and power.

One of the objects of this invention is to provide a manually operated, mechanical, rod holder that is economical, effective, and easy to use and maintain.

Other objects will become apparent to those skilled in the an in the light of the following description and accompanying drawing.

SUMMARY OF THE INVENTION

In accordance with this invention, generally stated, a manually operated mechanical rod holder is provided having a support arm, an inner end of which is pivotally mounted on a chassis of a drill rig carder and on an outer end of which a fixed jaw is mounted. A housing is mounted at the outer end of the support arm. The housing is open at two ends, defining a passage extending through the housing parallel to the long axis of the support arm. A sleeve configured complementarily to the walls defining the passage, is slidably mounted in the housing. A movable jaw arm or plate is fixed to the outer end of the sleeve, and carries a movable jaw mounted in such a way as to face the fixed jaw. An operating block is slidably mounted in the sleeve. In the embodiment shown and described, the block is drilled on an axis parallel with the center line of the housing and sleeve, to receive a heavy bolt, extending through the movable jaw mounting arm and threaded into a screw boss bolted onto the outer end of the block and concentric with the bolt hole in the block.

An operating lever has an arcuate spring section, integral with the lever, an outer end of which section is pivotally connected to the sliding block, and an inboard end of which section is pivotally connected to an end of a link. The link is pivotally connected at its other end, to a knuckle fixed to the support arm. The operating lever has a handle at its inner end (remote from the jaws).

By rotating the bolt that extends through the movable jaw supporting arm, the jaw arm, hence the jaw, can be moved inwardly and outwardly with respect to the sliding block, thus adjusting the distance between the fixed jaw and the movable jaw.

When the handle is moved to its position close to the supporting arm, the movable jaw is moved toward the fixed jaw, the link moves over center, and the spring section acts to maintain pressure on the rod or pipe between the jaws.

DESCRIPTION OF THE PREFERRED EMBODIMENT

Figure 1:
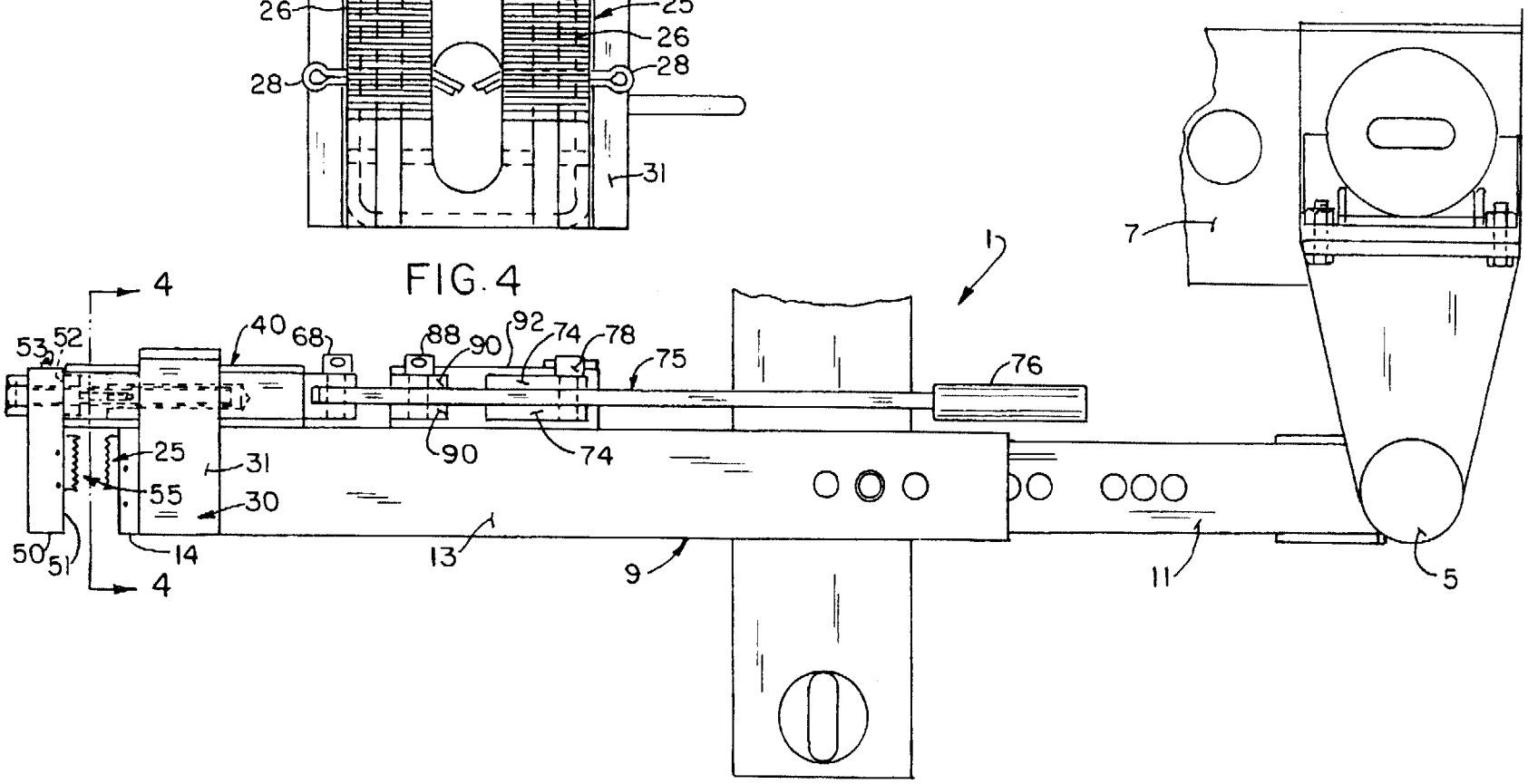
FIG. 1 is a top plan view of one embodiment of rod holder of this invention.
Figure 4:
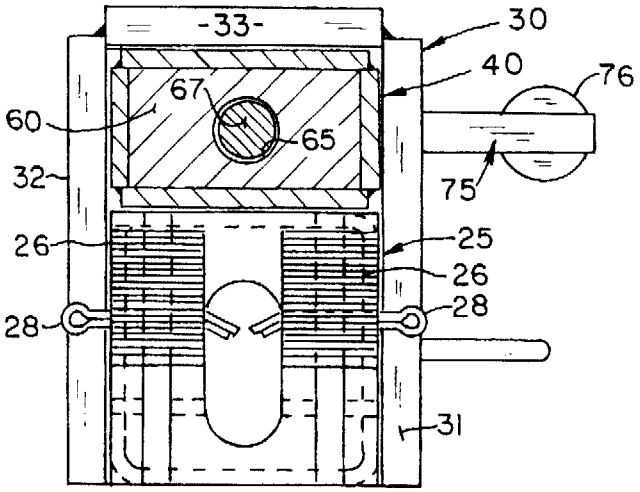
FIG. 4 is a sectional view taken along the line 4—4 of FIG. 1.
Figure 2:
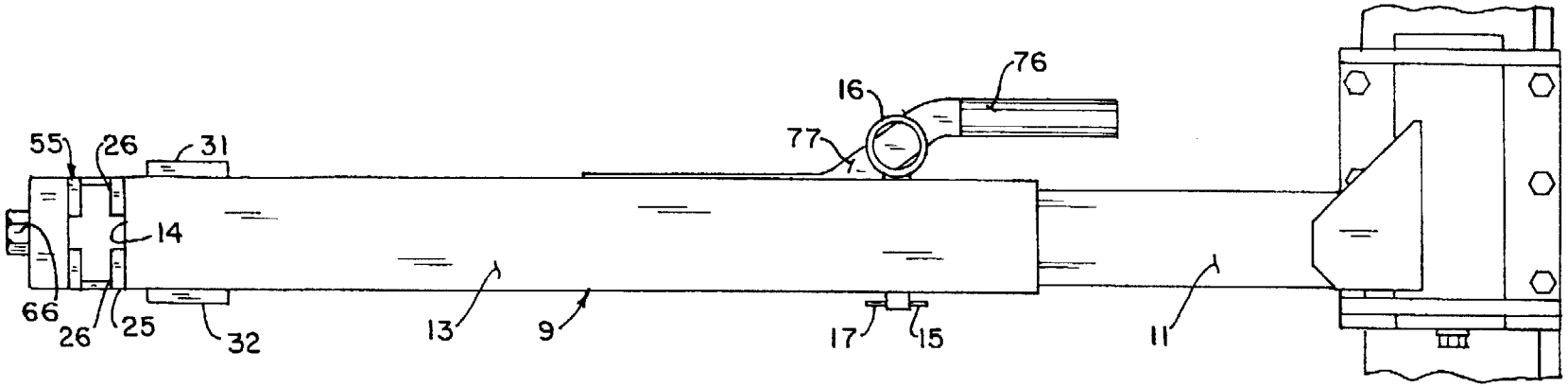
FIG. 2 is a view in side elevation toward a vehicle on which the device is mounted.

Referring now to the drawings for one illustrative embodiment of this invention, reference numeral 1 indicates a rod holder pivotally mounted on a post 5 secured to a chassis 7 of a truck or other vehicle on which a drill rig is carried, in much the same way as the hydraulic drill rods of U.S. Pat. Nos. 4,345,493 and 4,870,738 are mounted, the mounting of the rod holder on the vehicle forming no part of this invention.

The rod holder 1 includes a support arm 9 made up, in this embodiment, of an inner square tube 11 and an outer square tube 13, mounted on the inner square tube 11. An inboard end of the tube 11 is secured to the post 5, to project substantially horizontally. The outer square tube is adjustably mounted on the inner square tube, and is held in place by a heavy pin 15, with a harness ring 16 at its upper end to permit its easy removal, and a cotter pin 17 extending diametrically through it at its lower end, to prevent accidental displacement. The pin 15 extends through holes in the outer and inner square tubes. The holes in the tubes can be spaced so as to give a vernier adjustment of any desired fineness.

A fixed jaw 25 is mounted on an outboard end 14 of the outer tube 13, as by mounting a pair of spaced jaw members 26 by means of cotter pins 28, extending through ears on a plate welded to the end of the outer tube. Again, the matter in which the jaws are mounted on their carders does not form a part of this invention.

The outer tube 13 also carries near its outer end a housing 30 made up of an upper plate 31, welded to an upper surface of the square outer tube 13 and projecting beyond the edge of that upper surface, as shown particularly in FIG. 1, a lower plate 32 welded to a lower surface of the outer square tube 13, dimensioned and oriented as a mirror image of the plate 31, and a bridging plate 33 extending between and welded to projecting edges of the plates 31 and 32. Inner surfaces of the plates 31, 32 and 33, and a side surface of the outer square tube 13 define a straight passage in which a sleeve 40 is slidably mounted. As shown particularly in FIGS. 1 and 3, the sleeve 40 is elongated, projecting at each end from the housing 30. The sleeve 40 is made up of flat plates, dimensioned complementarily to the internal surfaces of the housing passage to permit the sleeve to be mounted closely but slidably within the confines of the passage.

Figure 3:
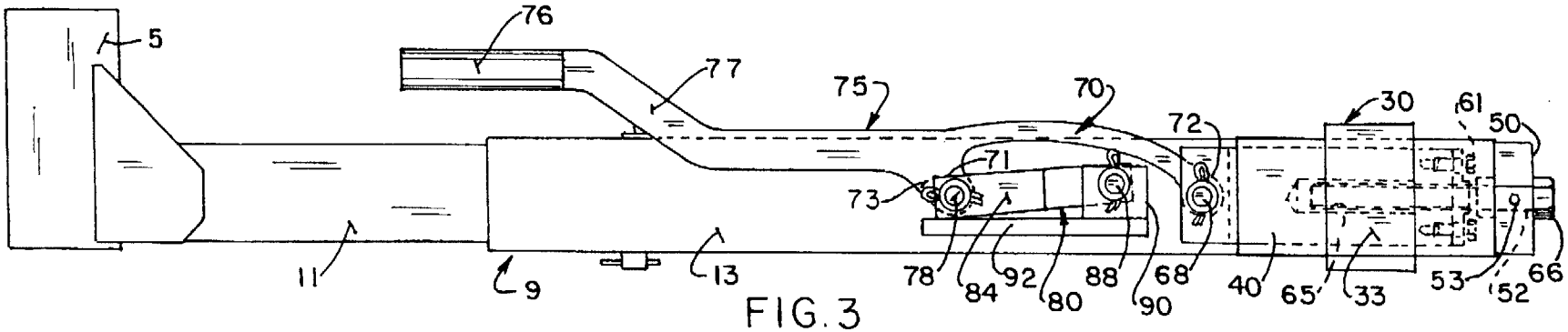
FIG. 3 is a view in side elevation of the device shown in FIGS. 1 and 2.

A heavy movable jaw arm or plate 50 is welded to the outboard end of the sleeve 40, as shown particularly in FIGS. 1 and 3. An inboard surface 51 of the plate 50 faces the jaw 25. A movable jaw 55 is mounted on the surface 51 in any suitable way, for example, as the fixed jaw 25 was mounted, and can be made in the form of two spaced members, in the same way as the fixed jaw.

A block 60 is slidably mounted within a passage defined by inner walls of the sleeve 40. The block 60 has at an outboard end, a blind hole 52, extending from an outer end toward an inner end of the block, aligned with a longitudinal center line of the support arm 9. The movable jaw plate 50 has a hole through it, aligned with the hole 52, with which a grease fitting 53 communicates. An adjustment bolt 65 with a head 66 and a threaded shank 67 has a smooth shank part that extends through the hole 52. The smooth shank part has a thrust ring mounted on it to prevent lateral movement of the bolt with respect to the plate 50. A threaded shank part 67 of the bolt engages threads in a boss plate 61 mounted on an outer end of the block 60, as shown in FIG. 3.

It can be seen that when the bolt 65 is rotated, the block 60 and the sleeve 40 move relative to one another.

At its inboard end, the block 60 is slotted to provide two, spaced ears through which aligned holes extend to take a pintle 68, which also extends through an eye in an outboard end 72 of an arcuate spring section 70 of an operating lever 75, the eye being positioned between the two ears. The spring section 70 has at an inboard end 71, a depending center knuckle section 73, with an eye through it, which extends within a space between plates 84 of a link 80 and is rotatably mounted between the plates 84 on a pin 78 projecting through aligned holes in the plates 84. The plates 84 are welded to opposite flat sides of a stem plate of the link, an outer end of which has hole through it to receive a pin 88 carded by spaced knuckles 90. The knuckles are welded to a shelf 92, which is in mm welded along a long edge to the contiguous flat side surface of the outer square tube 13. The shelf extends along the tube 13 sufficiently far to serve as a stop for the inboard end of the link 80, as well as the support for the outboard end of the link, as shown clearly in FIG. 3. The operating lever 75 has a handle part 76, at the inboard end of a dog-leg section 77 that positions the handle 76 clear of the support arm 9 to facilitate its use.

The spring section in the embodiment shown is of one piece with the operating lever, which is made of half inch heat treated alloy steel stock, for example, 4140, tempered after being cut to shape. In the present example, the operating lever is about 26 ½ inches long; the spring section about 7 ¾ inches measured center to center of the eyes, and about ⅝ of an inch deep vertically, at its longitudinal center. It is shaped as shown.

The construction of the present invention has several advantages, besides being simple and effective. The provision of an integral spring ensures a tight grip on the rod or pipe being held, after the link has gone over center. When the pipe or rod is to be released, the movable jaw is forced away from the fixed jaw positively, without any intermediate link or play in the connection.

Numerous variations in the construction of the rod holder of this invention within the scope of the appended claims will occur to those skilled in the art in the light of the foregoing disclosure. Merely by way of example and not of limitation, the spring section can be made of spring steel and the remainder of the operating lever, of mild steel, the two being welded or otherwise joined to form an integral piece, rather than a single unitary piece of the same material throughout. The amount of arch and the general configuration of the spring section can be varied, depending upon the amount of spring desired; the flatter the arch, the less spring. In any case, the travel of the movable jaw remains constant, although the spacing of the two jaws is adjustable by the adjusting screw. The configuration of the support arm, link, and the various ears and knuckles can be changed. The passage in the block can be internally threaded to eliminate the need for a separate thread boss. These variations are merely illustrative.

We claim:

1. A manually operated mechanical rod holder comprising a support arm, said support arm being pivotally mounted at an inboard end on a drill rig chassis; said support arm having an outboard end; fixed jaw means mounted on said outboard end; movable jaw supporting means for slidably supporting movable jaw means outboard of said fixed jaw means for movement of said movable jaw means toward and away from said fixed jaw means, and operating means connected to said movable jaw supporting means to move said movable jaw supporting means, hence said movable jaw means, toward and away from said fixed jaw means, said operating means comprising a lever arm having a handle part at an inboard end of said lever arm and, integral with said lever arm, an arcuate spring section pivotally connected at an outboard end to said movable jaw supporting means and at an inboard end, to an outboard end of a link, said link being pivotally connected at an inboard end of said link to said support arm, said link moving in response to rotation of said operating lever arm between a position at which it is above a line through the pivot axes of the outboard end of said link and the outboard end of said spring section and a position at which it is below said line.

2. The rod holder of claim 1 wherein said lever arm and said spring are one piece.

3. The rod holder of claim 1 including means for adjusting the position of said movable jaw in a direction toward and away from said fixed jaw with respect to said supporting means.

4. The rod holder of claim 1 wherein said movable jaw supporting means comprise an open ended housing secured to said support arm and defining a sleeve passageway oriented in a long direction of said support arm, a sleeve, slidably mounted in said housing, a movable jaw carrying plate secured to said sleeve, and a block slidably mounted in said sleeve, an inboard end of said block being pivotally connected to an outboard end of said spring section and an outboard end of said block being connected to said movable jaw carrying plate.

5. The rod holder of claim 4 wherein said outboard end of said block has a passage in it parallel to said long direction of said support arm, said movable jaw supporting means comprises a plate having a hole through it aligned with the passage in said block, a bolt extending through said hole in said plate and into said block passage, thread means on said block engaging complementary threads on said bolt, and means for restraining said bolt against longitudinal movement with respect to said plate.

6. A manually operated mechanical rod holder comprising a support arm, said support arm being pivotally mounted at an inboard end on a drill rig chassis; said support arm being manually extendable and retractable with respect to said pivotally mounted end; said support arm having an outboard end; fixed jaw means mounted on said outboard end; movable jaw supporting means for slidably supporting movable jaw means outboard of said fixed jaw means for movement of said movable jaw means toward and away from said fixed jaw means, and operating means connected to said movable jaw supporting means to move said movable jaw supporting means, hence said movable jaw means toward and away from said fixed jaw means, said operating means comprising a lever arm of spring steel having a handle part at an inboard end of said lever arm and, in one piece with said lever arm, an arcuate spring section pivotally connected at an outboard end to said movable jaw supporting means and at an inboard end, to an outboard end of a link, said link being pivotally connected at an inboard end of said link to said support arm, said link moving between a position at which it is above a line through the pivot axes of the outboard end of said link and the outboard end of said spring section and a position at which it is below said line, said movable jaw supporting means including a movable jaw carrying plate, and said operating means connected to said movable jaw supporting means comprising an open ended housing secured to said support arm and defining a sleeve passageway oriented in a long direction of said support arm, a sleeve, slidably mounted in said housing, said movable jaw carrying plate being secured to said sleeve, and a block slidably mounted in said sleeve, an inboard end of said block being pivotally connected to an outboard end of said spring section and an outboard end of said block being connected to said movable jaw carrying plate, said outboard end of said block having a passage in it parallel to said long direction of said support arm, said movable jaw carrying plate having a hole through it aligned with the passage in said block, a bolt extending through said hole in said plate and into said block passage, thread means on said block engaging complementary threads on said bolt, and means for restraining said bolt against longitudinal movement with respect to said plate.

* * * * *